US008931237B2

(12) United States Patent
Kloepfer et al.

(10) Patent No.: US 8,931,237 B2
(45) Date of Patent: Jan. 13, 2015

(54) ABUTMENT DEVICE, IN PARTICULAR FOR INSTALLING FLOOR ELEMENTS, AND METHOD FOR LAYING FLOOR ELEMENTS

(71) Applicant: BESSEY Tool GmbH & Co. KG, Bietigheim-Bissingen (DE)

(72) Inventors: Gerhard Kloepfer, Pleidelsheim (DE); Hans Roesch, Gemmrigheim (DE); Thomas Klein, Besigheim (DE); Roger Zampolli, Boennigheim (DE); Michael Duss, Besigheim (DE)

(73) Assignee: BESSEY Tool GmbH & Co. KG, Bietigheim-Bissingen (DE)

( * ) Notice: Subject to any disclaimer, the term of this patent is extended or adjusted under 35 U.S.C. 154(b) by 0 days.

(21) Appl. No.: 14/037,783

(22) Filed: Sep. 26, 2013

(65) Prior Publication Data

US 2014/0102037 A1 Apr. 17, 2014

Related U.S. Application Data

(63) Continuation of application No. PCT/EP2012/055233, filed on Mar. 23, 2012.

(30) Foreign Application Priority Data

Apr. 1, 2011 (DE) ..... 10 2011 001 729

(51) Int. Cl.
*E04B 1/00* (2006.01)
*E04F 21/22* (2006.01)

(52) U.S. Cl.
CPC . *E04F 21/22* (2013.01); *Y10S 52/01* (2013.01)
USPC ..... 52/747.11; 52/DIG. 1; 52/126.5; 33/526

(58) Field of Classification Search
USPC ..... 52/126.1, 126.5, DIG. 1, 747.11; 33/526, 527, 613, 645
See application file for complete search history.

(56) References Cited

U.S. PATENT DOCUMENTS

| | | | | |
|---|---|---|---|---|
| 5,181,326 | A | 1/1993 | Eberline | |
| 5,971,361 | A | 10/1999 | Heimbach et al. | |
| 8,534,526 | B2 * | 9/2013 | Orchard | 227/107 |
| 2008/0134535 | A1 * | 6/2008 | Webb | 33/645 |

FOREIGN PATENT DOCUMENTS

| | | |
|---|---|---|
| DE | 93 05 140 | 7/1993 |
| DE | 44 04 310 | 8/1995 |
| DE | 202 00 281 | 6/2002 |
| DE | 20 2007 000 195 | 6/2008 |
| EP | 0 805 245 | 11/1997 |
| WO | WO 96/15340 | 5/1996 |

* cited by examiner

*Primary Examiner* — William Gilbert
*Assistant Examiner* — Gisele Ford
(74) *Attorney, Agent, or Firm* — Lipsitz & McAllister, LLC

(57) ABSTRACT

An abutment device, in particular for laying floor elements, is proposed, comprising a first abutment element with a first abutment face and a second abutment face, which is oriented transversely to the first abutment face, and a second abutment element with a third abutment face, which is oriented transversely to the first abutment face, and which second abutment element is slidingly displaceably guided in a fixable manner on the first abutment element, a spacing between the first abutment face and the third abutment face being fixably adjustable, the first abutment element, on a side opposite to the first abutment face, having a recess, which is limited by an edge and in which the second abutment element is arranged.

27 Claims, 16 Drawing Sheets

ABUTMENT DEVICE, IN PARTICULAR FOR INSTALLING FLOOR ELEMENTS, AND METHOD FOR LAYING FLOOR ELEMENTS

This application is a continuation of international application number PCT/EP2012/055233 filed on Mar. 23, 2012 and claims the benefit of German application number 10 2011 001 729.1 filed on Apr. 1, 2011, which are incorporated herein by reference in their entirety and for all purposes.

BACKGROUND OF THE INVENTION

The invention relates to an abutment device, in particular for laying floor elements, comprising a first abutment element with a first abutment face and a second abutment face, which is oriented transversely to the first abutment face, and a second abutment element with a third abutment face, which is oriented transversely to the first abutment face, and which is slidingly displaceably guided in a fixable manner on the first abutment element, a spacing between the first abutment face and the third abutment face being fixably adjustable.

The invention further relates to a method for laying floor elements.

If, for example, a parquet floor or laminate floor is to be laid, a specific spacing from a wall has to be fixed in the first row of the floor elements (floor elements close to a wall). For example wedges are used for this purpose.

A laying aid for laminate panels is known from DE 20 2007 000 195 U1, with an overlay for placing on a laminate panel and with a spacer, which has an adjusting mechanism, a first cheek projecting downwardly next to the overlay for placing on an edge of the laminate panel and a second cheek opposing the first cheek, the first and the second cheek determining the width of the spacer and being adjustable relative to one another using the adjusting mechanism in such a way that the width of the spacer can be adjusted. The adjusting mechanism has a latching mechanism, which stops an adjustment of the width of the spacer in the latched-in state.

An arrangement for laying a floor covering is known from EP 0 805 245 A2, in which a rail is provided, against which the floor covering can abut. A device is provided, with the aid of which the position of the abutment rail can be adjusted and fixed.

A clampless tool for installing floor laminate is known from U.S. Pat. No. 5,971,361.

A laying rail with a base rail, through which a bore is introduced on each side, is known from DE 202 00 281 U1. There is guided through the bore a threaded bolt, on which a floor board with a bore for threaded bolts is placed and screwed with a nut.

An adjusting clamp for mounting boards or board-like components with a main part is known from WO 96/15340, which has a claw acting on the components, with a pressure piece, which is guided on the main part and intended for acting on a counter bearing, with a clamping element mounted on the main part and adjustable relative thereto and acting on the pressure piece on one side. The pressure piece is strip-like, guided in a U-shaped groove of the main part and pivotably connected to the clamping element only in the region of its longitudinal center.

A clamping tool in the manner of a screw clamp is known from DE 44 04 310 A1, consisting of a rail, sliding bracket and upper part. The upper part has a short leg in an L-shape with a small thickness dimension with an adjusting member above this short leg.

SUMMARY OF THE INVENTION

In accordance with the invention, an abutment device is provided, with which a spacing can be easily variably adjusted, the abutment device being easily releasable.

In accordance with an embodiment of the invention, in the abutment device the first abutment element, at a side opposite to the first abutment face, has a recess, which is limited by an edge and in which the second abutment element is arranged.

An abutment device of this type can be formed in a simple and compact manner. For example, an abutment device of this type can be produced from plastics material parts. It can thereby be realised correspondingly economically and realised with a low weight.

During the laying process, the first abutment element is laid on a floor element, so the first abutment face abuts on an upper side of the floor element and the second abutment face abuts on an end face. A wall spacing can then be adjusted and fixed by means of the relative displacement position between the second abutment element and the first abutment element. After the floor element has been fixed, the abutment device can easily be released even when there is a clamping, in that the spacing between the first abutment element and the second abutment element (in relation to the second abutment face and the third abutment face) is released or the fixing is eliminated.

An abutment device of this type can also be made with a low height. During the laying of the floor elements, a plurality of such abutment devices can also be used.

On a side opposite to first abutment face, the first abutment element has a recess, which is limited by an edge and in which the second abutment element is arranged. In particular, the second abutment element does not project beyond the edge in a height direction. A compact abutment device with minimized height dimensions can thus be realised. The second abutment element can thus be arranged and guided in the manner of a drawer on the first abutment element in the recess.

Since the second abutment element is located in the recess of the first abutment element, the first abutment element can be closed toward the second abutment face. This produces a high mechanical rigidity and stability of the first abutment element and therefore also of the abutment device. In turn, a mechanism for the movability of the first abutment element and the second abutment element can thus easily be arranged on one side of the first abutment element opposite to the second abutment face.

The corresponding mechanism is then also protected by the closed first abutment element (or the second abutment face) from soiling and damage etc. toward the second abutment face.

If, for example, a rotatable fixing element is provided, by means of which a relative position of the second abutment element with respect to the first abutment element is adjustably fixable in a direction from the third abutment face to the second abutment face, at most one recess (in the second abutment element) has to be provided for this fixing element. No recess basically restricting the rigidity has to be provided on the first abutment element.

In particular, the second abutment face and the third abutment face are at least approximately parallel to one another. An orientation, for example of a floor element to a wall, can thereby easily be adjusted.

It is favorable if the second abutment face projects beyond the first abutment face and, in particular, that the first abutment face and the second abutment face intersect in a line. The second abutment face can thus be placed transversely to one side, for example to a floor element, on which the first abutment face is placed. The first abutment element can thus no longer be displaced relative to the corresponding floor element, as the second abutment face is abutting.

The line is, in particular, at least approximately parallel to the third abutment face. This produces easy orientability.

It is favorable if the first abutment element, at least at the first abutment face and the second abutment face, has an L-shaped form in cross section. A leg for the second abutment face is thus provided to prevent a displacement of the first abutment element, for example on a floor element.

The corresponding abutment device can be produced in a simple and compact manner and, in particular, solely from a plastics material, if a first region of the first abutment element, on which the first abutment face is formed, and a second region of the first abutment element, on which the second abutment face is formed, are connected to one another in one piece.

It is favorable if the first abutment element has a profiling on the second abutment face. Slipping can thereby be prevented. Furthermore, irregularities, for example, on an element to be laid, such as a floor element, can be compensated. In some circumstances, the first abutment element may also have a lug for providing an undercut face.

It is favorable if the second abutment element is supported on the first abutment element. A sliding displacement can easily be realised by a corresponding support. The abutment element can in turn easily be formed thereby, and, in particular, completely realised from plastics material.

It is quite particularly advantageous if the second abutment element is linearly displaceably guided by means of a guide mechanism and on the first abutment element. The abutment device can thus be realised in a structurally simple manner. The guide mechanism can be easily formed and can also, in particular, be integrally formed on the first abutment element and/or the second abutment element.

It is favorable if the guide mechanism is configured as an anti-lift device for the second abutment element relative to the first abutment element. The individual parts of the abutment device can then be held together without, for example, screws or the like having to be provided.

In one embodiment, the guide mechanism has opposite guide recesses, which are in each case limited by a cover strip and in which respective guide strips are inserted. A linear guidance can thus easily be realised. Furthermore, an anti-lift device can be easily realised. A sliding displaceability of the second abutment element on the first abutment element can thereby be easily realised, in particular the first abutment element and second abutment element being able to be completely manufactured from plastics material. The corresponding guide mechanism can, in particular, be formed integrally if, for example, the abutment elements are produced by an injection-moulding method.

It is favorable if at least one cover strip is beveled on a side remote from the first abutment face. This facilitates the production of the abutment device. An insertion wedge, which facilitates assembly, is thereby provided.

It is quite particularly advantageous if a fixing mechanism is provided, by means of which a relative position of the second abutment element with respect to the first abutment element is adjustably fixable, at least in the direction of the third abutment face toward the second abutment face. This allows a defined spacing to be fixed and a defined spacing, for example of a floor element close to a wall from a wall can thereby be adjusted. The fixing does not necessarily have to take place in two directions here, but it is sufficient if a fixing takes place with respect to the displacement of the second abutment element in relation to the first abutment element.

It is favorable if the fixing mechanism has at least one fixing element, which is supported on the first abutment element and/or on the second abutment element. As a result, no threads are necessary, for example; the fixing is achieved by support (abutment).

In one embodiment, it is provided that a first fixing element is supported on a further fixing element.

It is favorable if the at least one fixing element has at least one gripping bar for hand actuation. This allows a user to easily take hold of the fixing element to actuate it (for example displacement and rotation) and a corresponding force effect can be exerted.

It is quite particularly advantageous if the at least one fixing element is movably arranged relative to the first abutment element and movably arranged relative to the second abutment element. The movability may be a linear displaceability or rotation etc. A sliding displacement of the first abutment element with respect to the second abutment element can be brought about and fixed thereby by relative movement of the at least one fixing element relative to the first abutment element and the second abutment element.

In particular, the at least one fixing element is movable in a direction oriented transversely to a movement direction of the second abutment element relative to the first abutment element and, in particular, a guide mechanism is provided for the movable mounting of the at least one fixing element. It may, for example, be provided that the at least one fixing element is linearly displaceable with a linear displacement direction, which is transverse (and, in particular, perpendicular) to a displacement direction of the second abutment element with respect to the first abutment element (with respect to the sliding displaceability). It is also possible, that the at least one fixing element is rotatably mounted with a rotation angle direction, which is transverse to the displacement direction of the second abutment element with respect to the first abutment element.

In one embodiment, the at least one fixing element is linearly displaceably mounted on the first abutment element and/or the second abutment element. It is thus possible to easily realize a spacer, which fixes a specific displacement position of the second abutment element with respect to the first abutment element.

In particular, the at least one fixing element is configured as a wedge element. Different spacings can thus easily be adjusted.

It is favorable if the at least one fixing element has an oblique side, which is oriented at an acute angle with respect to the third abutment face and on which a support face is formed, the at least one fixing element being supported on a corresponding oblique side of the first abutment element or of the second abutment element or a further fixing element, which is oriented parallel to the oblique side of the at least one fixing element. A spacer mechanism, which fixes a displacement position relatively between the second abutment element and the first abutment element can thus easily be realised and, in particular, in a thread-free manner. This displacement position is in turn variably fixable. Furthermore, the corresponding abutment device can be easily realised and, in particular, realised fully from plastics material.

It is advantageous if the mutually supporting oblique sides are provided with a profiling. The profiling is, for example, an undulating structure. If, for example, an undulation peak of an oblique side is introduced into an undulation trough of a supporting oblique side, a self-locking is achieved.

In one embodiment, it is provided that the at least one fixing element or a further fixing element is linearly displaceably guided on the second abutment element. This achieves an additional stabilization of the abutment device and play can also be reduced thereby.

In particular, it is provided that the at least one fixing element forms a spacer between the second abutment element and the first abutment element, which fixes the spacing between the second abutment face and the third abutment face, at least in one direction. The fixing, which is variable, is then not achieved by a thread or the like, but by one or more movable spacers.

In a further embodiment, the at least one fixing element is rotatably mounted on the second abutment element. By adjusting a specific rotational position of this fixing element, a displacement position between the second abutment element and the first abutment element can then be fixed.

In an embodiment of this type, the abutment device can be realised with a minimized number of components. In principle, the abutment device can be realised with only three separate components, namely the first abutment element, the second abutment element and the rotatable fixing element. Corresponding elements to hold the second abutment element on the first abutment element, to hold the rotatable fixing element, for the relative sliding displaceability of the second abutment element and the first abutment element, for the displacement actuation of the displacement between the first abutment element and the second abutment element and for fixing the spacing, can be integrally arranged on the corresponding component (first spacer element, second spacer element, rotatable fixing element).

In particular, an eccentric mechanism is provided, by means of which, by rotating the at least one fixing element, a linear displacement of the second abutment element relative to the first abutment element can be fixably actuated. A rotational movement can be converted into a linear movement by the eccentric mechanism. With a corresponding configuration of the eccentric mechanism, a fixing can be simultaneously achieved.

It is particularly advantageous if the eccentric mechanism is self-locking, so by means of a specific rotational position of the at least one fixing element, a relative displacement position between the second abutment element and the first abutment element is fixed. A self-locking configuration of this type can, for example, be achieved in a simple manner, if the eccentric mechanism comprises a spiral such as a logarithmic spiral.

For example, an eccentric guide path for at least one engagement element is arranged on the at least one fixing element or the first abutment element, the at least one engagement element being seated on the first abutment element or the at least one fixing element. A guideway is thereby formed, which, on the one hand, provides for the displacement movement and with which, on the other hand, a fixing is formed when there is a corresponding adaptation of the engagement element and guide path.

In particular, the eccentric guide path is a spiral path. As a result, a self-locking effect can easily be achieved.

An abutment device according to the invention can be advantageously used for laying floor elements close to a wall.

In accordance with the invention, a method is provided, by means of which floor elements can easily be laid.

In accordance with an embodiment of the invention, at least one abutment device according to the invention is placed with the first abutment face on an upper side of a floor element close to a wall, the second abutment face is placed on an end face of the floor element facing a wall, and the third abutment face is placed on the wall, the spacing of the floor element from the wall being adjusted by means of the relative position of the second abutment element with respect to the first abutment element.

The method according to the invention has the advantages already described in conjunction with the abutment device according to the invention.

The abutment device can be easily released: after the floor element has been fixed, the at least one abutment device is removed upwardly, in particular a possible clamping of the abutment device between the wall and floor element being released especially beforehand by releasing the fixing and/or changing the position of the second abutment element with respect to the first abutment element. The clamping can easily be eliminated by acting on the abutment device.

The following description of preferred embodiments is used to describe the invention in more detail in conjunction with the drawings.

DETAILED DESCRIPTION OF THE INVENTION

Figure 1:
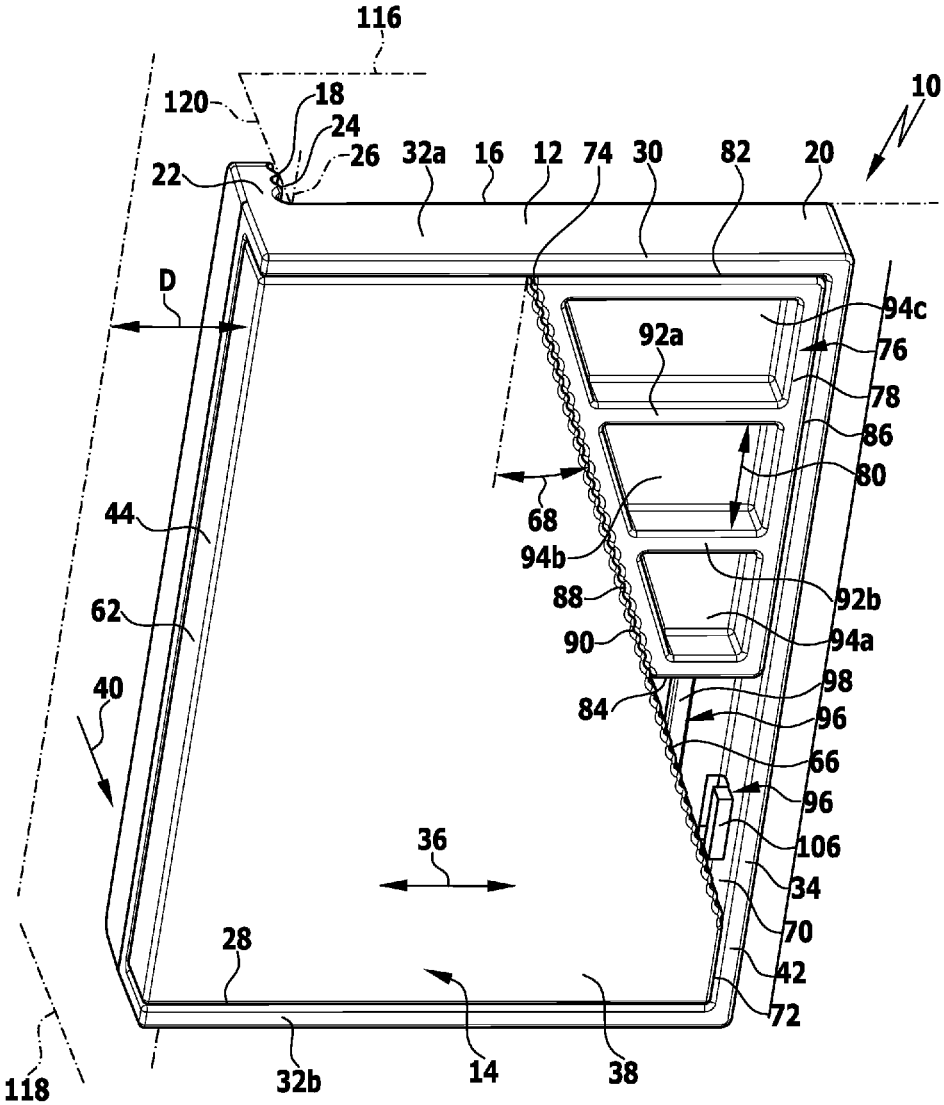
FIG. 1 shows a perspective view of a first embodiment of an abutment device according to the invention with a first abutment element and a second abutment element in a basic position.
Figure 2:
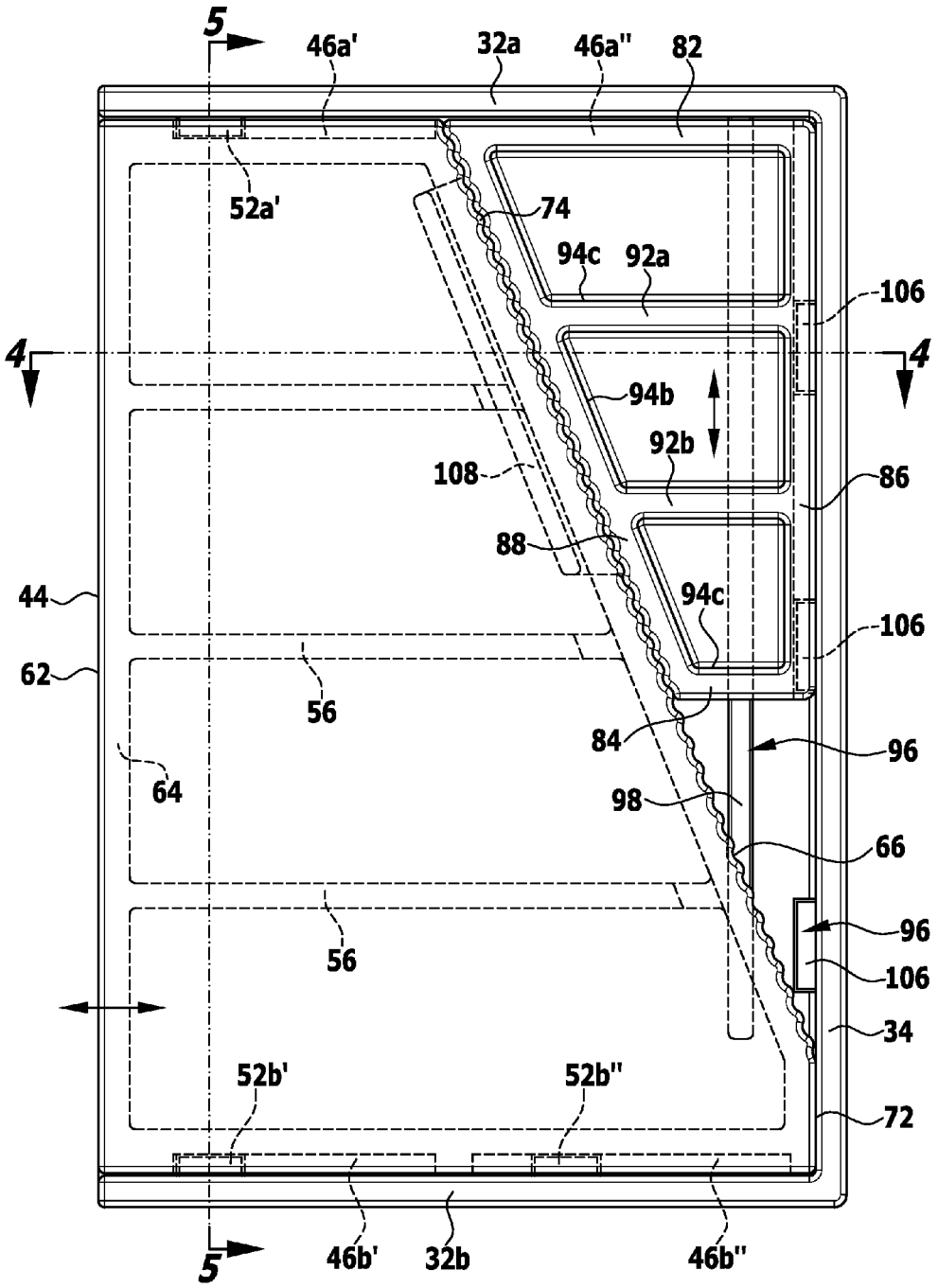
FIG. 2 shows a plan view from above of the abutment device according to FIG. 1.
Figure 3:
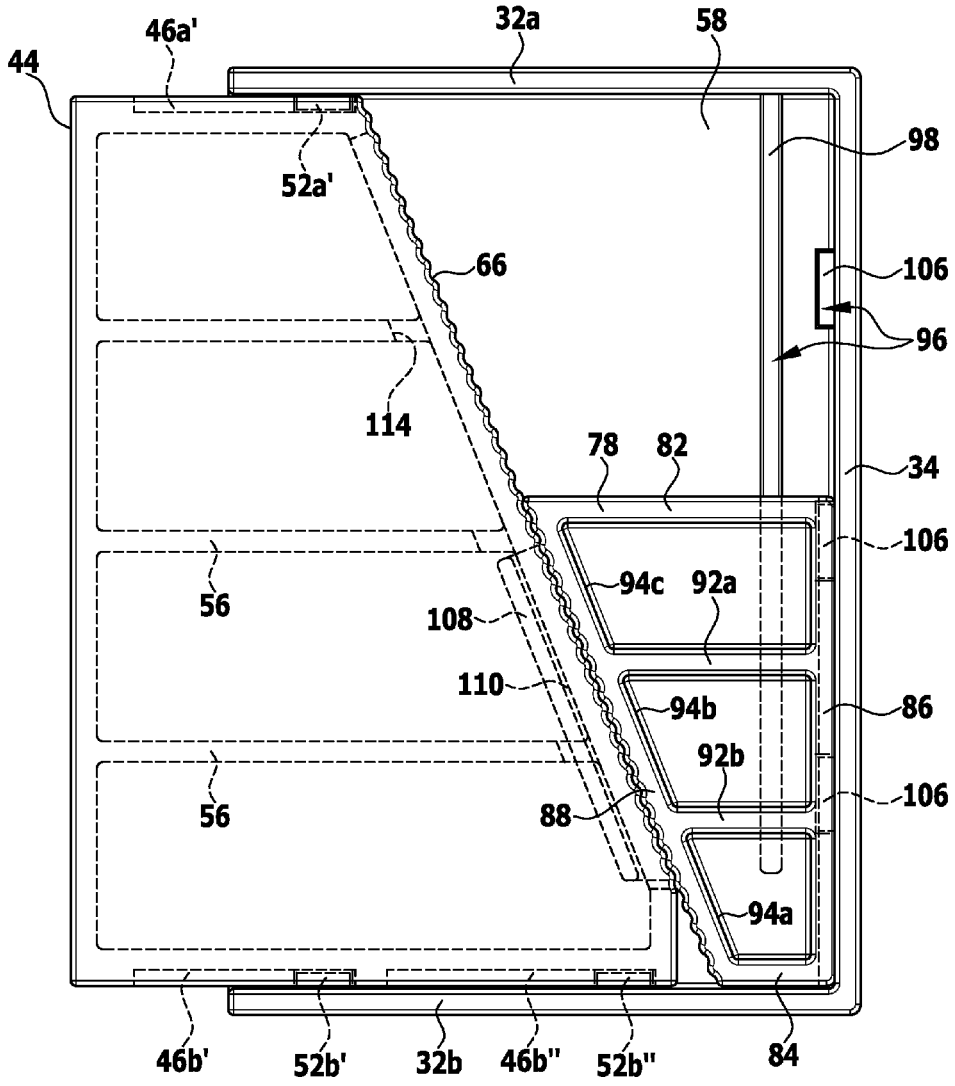
FIG. 3 shows the same view as FIG. 2, the second abutment element being displaced forward relative to the first abutment element.

A first embodiment of an abutment device according to the invention, which is shown in FIGS. 1 to 5 and designated 10 there, comprises a first abutment element 12 and a second abutment element 14. The first abutment element 12 has a cross sectionally L-shaped form (cf. FIG. 4) with a first abutment face 16 and a second abutment face 18. The first abutment face 16 is formed on a first region 20 of the first abutment element 12. The second abutment face 18 is formed on a second region 22 of the first abutment element 12. The first region 20 and the second region 22 are, in particular, connected to one another in one piece.

The second abutment face 18 is transverse and, in particular, perpendicular to the first abutment face 16. The second region projects beyond the first region 20.

In one embodiment, the second abutment face 18 is provided with a profiling 24. This profiling is, for example, formed by an undulating structure.

The first abutment face 16 and the second abutment face 18 intersect in a line 26.

The first abutment element 12 has a recess 28 on a side opposite to the first abutment face 16. This recess 28 is open toward an upper side in a direction of the surface normal of the first abutment face 16. It is limited laterally and to the rear by an edge 30, the edge 30 having opposite lateral edge elements 32*a*, 32*b* lying parallel to one another, and a rear edge element 34. The rear edge element 34 is connected to the lateral edge element 32*a*, 32*b* and arranged in a region of the second abutment element 12, which is remote from the second region 22 with the second abutment face 18.

The recess 28 is open to the front, at a side opposing the rear edge element 34, in continuation of the second region 22.

The recess 28, for example, has the form (at least approximately) of a hollow cuboid.

The first abutment element 14 is arranged in the recess 28 and linearly displaceably guided thereon. In this connection, a displacement direction 36 is transverse and, for example, at least approximately perpendicular, to the second abutment face 18 and at least approximately parallel to the first abutment face 16. For example, the deviation from the exact parallelism is at most 10%.

The first abutment element 14 is preferably arranged and configured here in such a way that an upper side 38 of the second abutment element 14, which is remote from the first abutment face 16, does not project beyond the edge 30 in a height direction 40 (which is a normal direction with respect to the first abutment face 16) and is, for example, aligned with a corresponding upper side 42 of the edge 30.

The second abutment element 14 has a third abutment face 44. This third abutment face 44 is oriented transversely and, in particular, perpendicularly to the first abutment face 16. The third abutment face 44 is at least approximately parallel to the second abutment face 18 of the first abutment element 12. By means of a corresponding relative positioning of the second abutment element 14 relative to the first abutment element 12 in the displacement direction 36, a spacing can be adjusted between the third abutment face 44 and the second abutment face 18.

Respective guide recesses 46*a*, 46*b* are formed facing one another on the lateral edge elements 32*a*, 32*b*. These guide recesses 46*a*, 46*b* are, for example, configured as grooves. A guide recess 46*a*, 46*b* is in each case upwardly limited (away from the first abutment face 16) by a cover strip 48*a*, 48*b*.

It is basically possible here for the guide recesses 46*a*, 46*b* on the rear edge element 34 to be continuous and to extend, for example, substantially over the entire length of the corresponding lateral edge element 32*a*, 32*b* from the front side to the rear edge element 34. It is also possible for the guide recess 46*a*, 46*b* to be shorter than said length. It is furthermore possible for a plurality of guide recesses 46*a*', 46*a*" or 46*b*', 46*b*", which are spaced apart with respect to one another, to be arranged on the corresponding lateral edge element 32*a*, 32*b* (cf. FIG. 2).

In one embodiment, the cover strip 48*b* is beveled on a side 50 remote from the first abutment face 16, a height in the height direction 40 of the cover strip 48*b* reducing in the direction away from the lateral edge element 32*b*. This bevel on the side 50 is an introduction facilitating device of a strip element 52*b* of the second abutment element 14 into the associated guide recess 46*b* during production of the abutment device 10.

The second abutment element 14 has a cover element 54, which is spaced apart from the first abutment element 16. A plurality of ribs 56 is arranged, in particular in one piece, on the cover element 54. The second abutment element is supported on an upper side 58 of the first abutment element 12 by means of the ribs 56, the upper side 58 opposing the first abutment face 16.

In particular, the upper side 58 of the first abutment element 12 is oriented parallel to the upper side 38 of the second abutment element 14.

Outer ribs 60*a*, 60*b* are arranged on the cover element 54. The outer rib 60*a* is associated here with the lateral edge element 32*a* and directly adjacent thereto. The outer rib 60*b* is directly adjacent to the lateral edge element 32*b* and associated therewith. Seated on the outer rib 60*a* is a strip element 52*a*, which is introduced into the guide recess 46*a* on the cover strip 48*a*. The strip element 52*b* is seated on the outer rib 60*b* and is introduced into the guide recess 46*b* on the cover strip 48*b*.

The second abutment element 14 may, in each case, be laterally provided with a strip element 52*a* or 52*b* or a plurality of lateral strip elements 52*a*', 52*a*" or 52*b*', 52*b*" may be provided.

The ribs 56 and the strip elements 52*a*, 52*b* are dimensioned in relation to the guide recesses 46*a*, 46*b* and cover strips 48*a*, 48*b* in such a way that a linear guidance and, in particular, sliding guidance of the second abutment element on the first abutment element 12 is realised in the displacement direction 36. An anti-lift device in the height direction 40 for the second abutment element 14 in relation to the first abutment element 12 is produced by means of the cover strips 48*a*, 48*b*.

The second abutment element 14 is closed in a front region 62, so the ribs 56 are covered to the front by walls 64 (see, for example, FIG. 2), which are oriented transversely to the ribs 56. The third abutment face 44 is in turn formed on this front region 62 on an outer side of the walls 64. This third abutment face 44 is preferably closed (simply connected).

The second abutment element 14 is guided slidingly displaceably in a fixable manner (see below) in the displacement direction 36 in the manner of a drawer on the first abutment element 12.

The second abutment element 14 has an oblique side 66 facing the rear edge element 34. This oblique side 66 is oriented at an acute angle 68 to the line 26 or oriented at an acute angle 68 to a perpendicular to the displacement direction 36. The acute angle 68 is, for example, in the order of magnitude of between 15° and 30°.

In one embodiment, a rear side 70 of the second abutment element 12, which is remote from the front region 62 and faces the rear edge element 34, has the oblique side 66, which merges into a side 72, which is oriented parallel to the line 26. In this connection, the side 72 has a length, which is substantially shorter than the length of the oblique side 66.

The oblique side 66 is provided with a profiling 74. This profiling 74 is, for example, formed by an undulating structure.

The abutment device 10 comprises a fixing mechanism 76. By means of this fixing mechanism 76, a relative displacement position between the second abutment element 14 and the first abutment element 12 can be fixed in the displacement direction 36, specifically such that with an adjusted relative position between the second abutment element 14 and the first abutment element 12, the second abutment element 14 cannot be displaced in the direction of the rear edge element 34. (As will be described in more detail below, a displacement of the second abutment element 14 away from the rear edge element 34 can basically be enabled; this does not limit the operation of the abutment device 10.)

The fixing mechanism 76 comprises a fixing element 78. Precisely one fixing element 78 is provided in the abutment device 10. This fixing element 78 is configured as a wedge element. It is linearly displaceably arranged in a direction 80 between the second abutment element 14 and the edge 30, this displacement direction 80 being transverse and, in particular, perpendicular to the displacement direction 36.

The fixing element 78 has a first side 82 and an opposite side 84. The sides 82 and 84 are parallel to one another and oriented parallel to the lateral edge elements 32*a*, 32*b*. The side 82 and the side 84 are connected by a side 86, which is oriented parallel to the displacement direction 80 and oriented parallel to the rear edge element 34. This side 86 is closest to the rear edge element 34. The sides 82 and 84 are furthermore connected by an oblique side 88. This oblique side 88 is oriented parallel to the oblique side 66 of the second abutment element 14. The oblique side 88 is supported here on the oblique side 66. The oblique sides 88 and 66 form support faces for supporting the second abutment element 14 on the fixing element 78.

The fixing element 78 is provided with a profiling 90 on the oblique side 88. The profiling 90 is, for example, formed by an undulating structure.

The profilings 74 and 90 are adapted to one another, specifically in such a way that when the oblique side 88 is supported on the oblique side 66, a type of self-locking effect is achieved; if, for example, a peak of the profiling 90 is inserted into a trough of the profiling 74, an exertion of force is necessary to guide such a peak out of the trough. Without providing a force of this type, the fixing element 78 cannot move in the displacement direction 80. (By pulling the second abutment element 14 to the front away from the fixing element 78, the "hooking" of the profiling 90 to the profiling 74 can easily be overcome.)

The fixing element 78 has bars 92*a*, 92*b* located between the oblique side 88 and the side 86. These bars 92*a*, 92*b* are gripping bars, of which the operator can take hold of the fixing element 78 in order to displace it, in particular, in the displacement direction 80.

The bar 92*a* rises above depressions 94*b*, 94*c*; the bar 92*b* rises above a depression 94*a* and the depression 94*b*. The fixing element 78 does not then project beyond the edge 30, in particular in the height direction 40.

It is alternatively also possible for the bars 92*a*, 92*b* to be arranged projecting beyond an upper side of the fixing element 78.

The bars 92*a*, 92*b* are, in particular, formed in one piece on the fixing element 78.

It is basically possible for only one bar to be provided or for more than two webs to be provided.

The fixing element 78 is slidingly displaceably guided on the first abutment element 12. For this purpose, a guide mechanism 96 is provided. The guide mechanism 96 has a guide strip 98, which is oriented parallel to the displacement direction 80 and is arranged on the first abutment element 12 rising above the upper side 58 thereof.

The fixing element 78 has a corresponding guide recess (guide groove) 100 (cf. for example, FIG. 4), by means of which the fixing element 78 is placed on the guide strip 98, the guide strip 98 being inserted into the guide recess 100. A lower side 102 is supported on the upper side 58 of the first abutment element 12 and is slidingly guided thereon.

The guide mechanism 96 furthermore comprises one or more guide recesses 104 (see for example FIG. 4), which face the rear edge element 34. A corresponding guide recess 104 is, in particular, configured as a groove.

One or more tongues 106 are arranged on the rear edge element 34, one tongue 106 being inserted in a corresponding guide recess 104. A tongue 106 of this type provides an anti-lift device for the fixing element 78 in the height direction 40 relative to the first abutment element 12.

The (at least one) guide strip 98, which is oriented in the displacement direction 80, ensures the actual linear guidance of the fixing element 78 in this direction. The guide recess or guide recesses 104, corresponding to the corresponding tongues 106, ensure an anti-lift device and also a linear guidance in the region of the rear edge element 34.

It may also be provided that the fixing element 78 is guided by means of a corresponding guide mechanism on the second abutment element 14.

Figure 4:
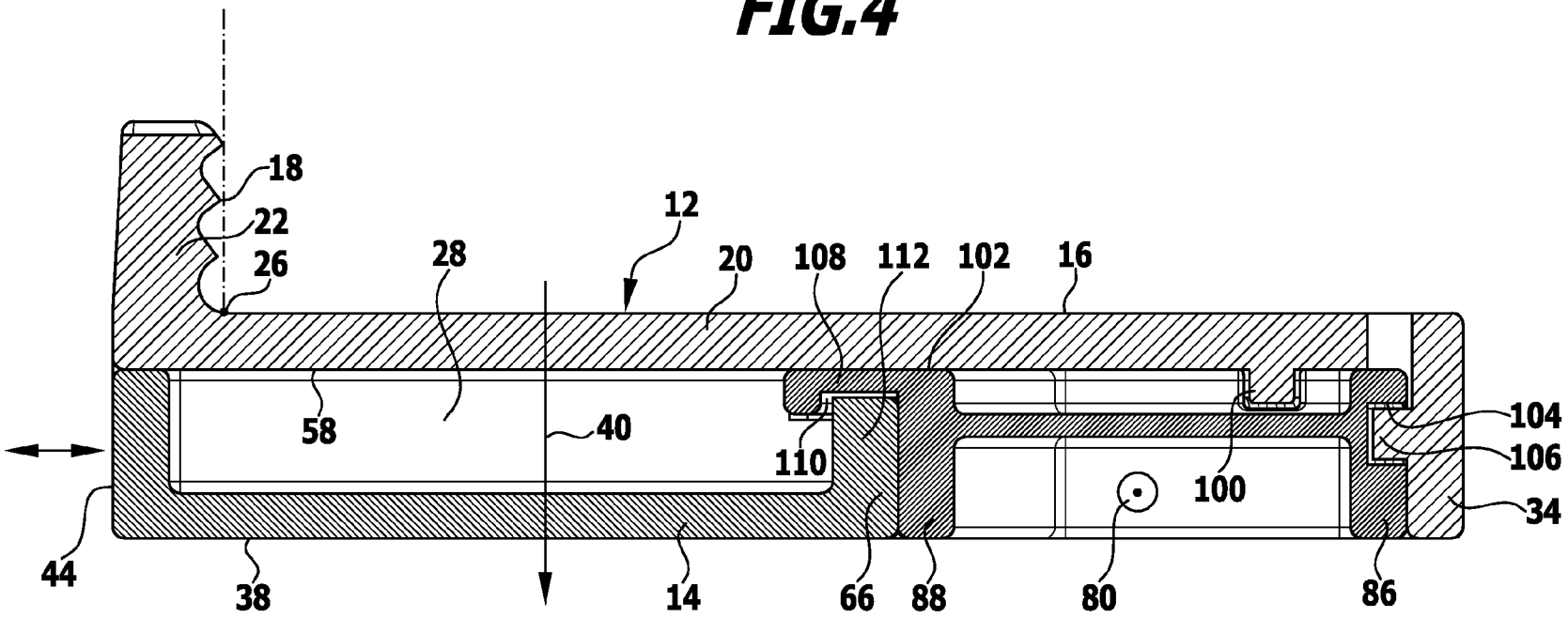
FIG. 4 shows a sectional view along the line 4-4 according to FIG. 2.
Figure 5:
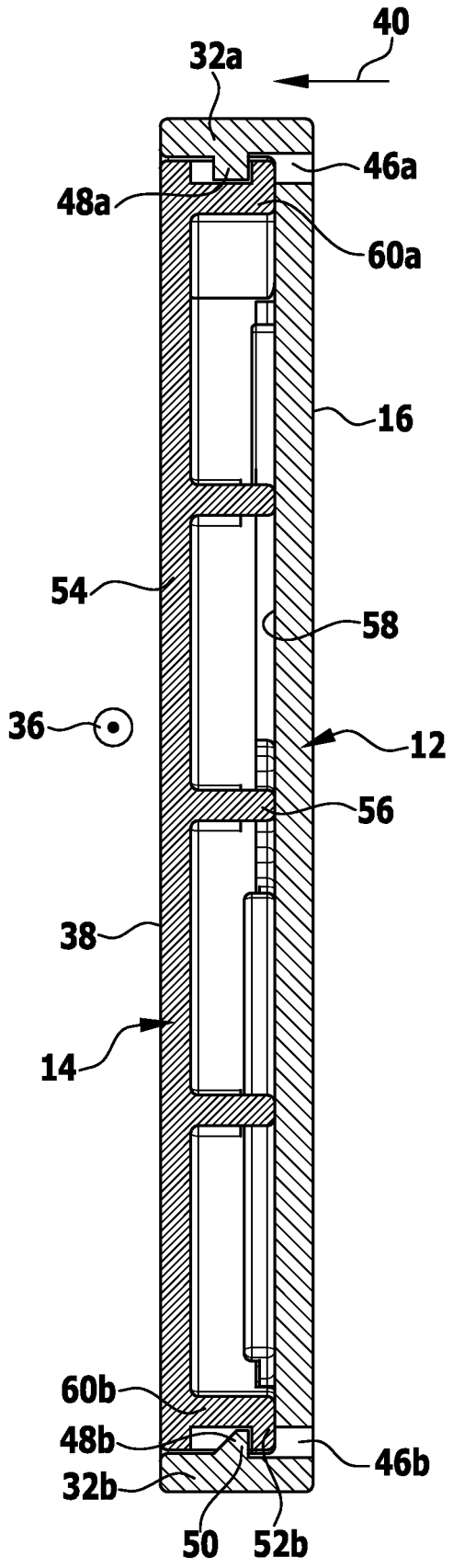
FIG. 5 shows a sectional view along the line 5-5 according to FIG. 2.
Figure 6:
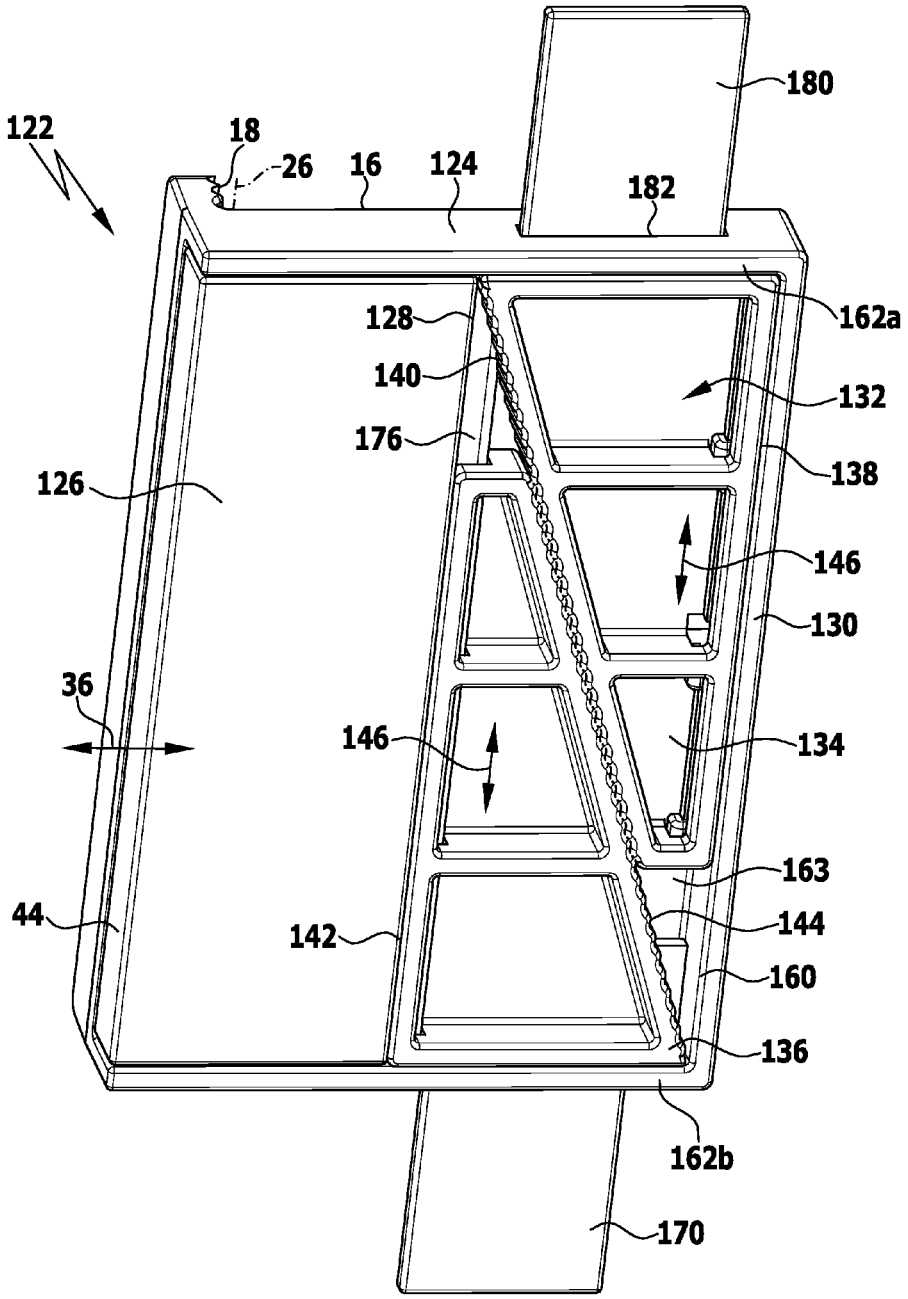
FIG. 6 shows a perspective view of a second embodiment of an abutment device according to the invention.

For example, the fixing element 88 comprises a foot 108 for this, which is slidingly guided on the upper side 58 of the first abutment element 12 (see FIG. 4). The foot 108 is arranged on the oblique side 66 and extends toward the second abutment element 18.

A recess 110 is formed on the foot 108. An insertion element 112, which is arranged on the oblique side 66 of the second abutment element 14, is inserted into this recess 110. Formed by the recess 110 and the insertion element 112 is a guide mechanism, by means of which the fixing element 78 is linearly displaceably guided on the second abutment element 14, this guide mechanism being configured in such a way that displacement along the displacement direction 80 is not obstructed.

The ribs 56 are arranged and configured here in such a way that the foot 108 can be pushed past them (cf. FIG. 2), in other words, the ribs do not extend to the introduction element 112, but have a respective end 114, which faces the oblique side 66 and is spaced apart here from the introduction element 112 in such a way that the foot 108 of the fixing element 78 can be guided past them.

The second abutment element is supported on the fixing element 78 by direct contact of the oblique sides 66 and 88. The fixing element 78 is in turn supported on the abutment element 12 by means of the guide mechanism 96. Basically, the fixing element 78 can also be supported on the rear edge element 34.

The abutment device according to the invention functions as follows:

During the laying of floor elements (in particular floor panels), a specific spacing from a wall 118 has to be adhered to in a first row of floor elements 116 close to the wall (cf. FIG. 1), depending on the circumstances. A spacing of this type can easily be adjusted in a defined manner by one or more abutment devices 10 according to the invention. An abutment device 10 is a laying aid for, for example, parquet panels or laminate panels. For example, a use for stone elements or ceramic elements is also possible etc.

For this purpose, the abutment device 10 is placed on the floor element 116 close to the wall, specifically in such a way that the first abutment face 16 is placed on an upper side of the floor element 116 close to the wall and the second abutment face 18 abuts on an end face 120 of the floor element 116 close to the wall, this end face 120 facing the wall 118.

FIG. 1 shows a basic position of the second abutment element 14. The second abutment element is not pushed out there relative to the first abutment element 12.

To adjust the specific spacing D, the second abutment element 14 is now pushed out to the front relative to the first abutment element 12 in the direction of the wall 118. This can take place directly or by means of a movement of the fixing element 78 in the displacement direction 80. The defined spacing D is adjusted by positioning the fixing element along the displacement direction 80. The fixing element 78 secures this specific spacing D here by its position. The second abutment element 14 is supported by its oblique side 66 on the fixing element 78 and the latter in turn on the first abutment element 12. As a result, this spacing D cannot be increased, in other words, the second abutment element 14 cannot be displaced in the direction of the rear edge element 34 if the fixing element 78 is not displaced. The fixing element 78 forms a spacer between the second abutment element 14 and the first abutment element 12 and the spacing D is in turn fixed thereby.

After the floor element 116 close to the wall has been fixed, the abutment device 10 can be removed upwardly. If the latter is clamped with the wall 118 and the floor element 116, this clamping can be released in a simple manner in that the fixing element 78 is correspondingly displaced, so the spacing D can be increased. The abutment device 10 can then be removed upwardly.

The abutment device 10 is compact. It allows, in a defined manner, a wall spacing, for example of a floor element 116 close to a wall, to be adjusted and this spacing close to the wall can easily be fixed. Furthermore, the abutment device can also easily be released in the case of a clamping of the abutment device 10 between the wall 118 and floor element 116 close to the wall.

The foot 108 also provides an anti-release device of the second abutment element 14 with respect to the first abutment element 12 in the displacement direction 36.

A second embodiment of an abutment device according to the invention, which is shown in FIGS. 6 to 11, in turn comprises a first abutment element 124 and a second abutment element 126, which can be fixably displaced with respect thereto. The second abutment element 126 is fixably displaceable with respect to the first abutment element 124 in the displacement direction 36.

The second abutment element 126, in contrast to the second abutment element 14 of the abutment device 10, does not have an oblique side 66, but a side 128, which faces a rear edge element 128 (corresponding to the rear edge element 130 of the abutment device 10) and is oriented at least approximately parallel to this rear edge element 130; in particular, the side 128 is oriented at least approximately parallel to a direction perpendicular to the displacement direction 36. A fixing mechanism 132 for fixing the second abutment element 126 on the first abutment element 124 in a specific displacement position (lacuna), in such a way that the spacing between the side 128 and the rear edge element 130 is fixed in such a way that that this spacing cannot be reduced.

The fixing mechanism 132 comprises a first fixing element 134, which is formed as a wedge element, and a further, second fixing element 136, which is also formed as a wedge element. The second abutment element 126 is supported here on the second fixing element 136. The latter is in turn supported on the first fixing element 134 and the first fixing element 134 is supported on the first abutment element 124.

The first fixing element 134 has a side 128, which is oriented parallel to the rear edge element 130. Furthermore, it has an opposite side 140, which is an oblique side and is oriented at an acute angle to the line 26. The second fixing element 136 has a side 142, which faces the side 128 of the second abutment element 126 and is directly adjacent thereto. It has an opposite oblique side 144. This oblique side 144 is oriented parallel to the oblique side 140 of the first fixing element 134. The oblique sides 140 and 144 form support faces, by means of which the second fixing element 136 is supported on the first fixing element 134. A profiling corresponding to the profilings 74, 90 can be provided here.

The first fixing element 134 and the second fixing element 136 are in each case displaceable in a displacement direction 146, the displacement direction 146 being transverse and, in particular, perpendicular to the displacement direction 36. The displacement direction 146 is, in particular parallel to the line 26, in which the first abutment face 16 and the second abutment face 18 meet. (The same reference numerals are used for the same elements as in the abutment device 10.)

The second abutment element 126 is placed with a lower side 148 (see, for example, FIG. 10) on a corresponding upper side 150 of the first abutment element 124, in other words is supported thereon and slidingly guided. In connection therewith, the second abutment element 126 comprises a first region 152 and a second region 154 adjoining the first region. The first region 152 and the second region 154 are, in particular, connected to one another in one piece. The third abutment face 44 is arranged on the first region 152. The side 128 is located at the transition from the first region 152 to the second region 154. The first region 152 has a greater height in the height direction 40 than the second region 154. As a result, a step 156 is formed at a corresponding transition from the first region 152 to the second region 154. In connection therewith, the step 156 lies on an upper side 158 of the second abutment element 126 facing the lower side 148.

An end 160 of the second region 154, in a basic position of the second abutment element 126 with respect to the first abutment element 124, lies on the rear edge element 130.

It may be provided that the second region 154, on its outside with respective ends 160, provides a stop face for the rear edge element 130, these ends being formed on tongues 161. Located between these tongues 161 is a free space 163, which is used, for example, for a part of a guide mechanism of the first fixing element 134.

Cover strips 164*a*, 164*b* are formed on opposite lateral edge elements 162*a*, 162*b* (see, for example, FIG. 11) of the first abutment element 124. These limit guide recesses 166*a*, 166*b*. The second abutment element 126 with its second region 154 is inserted in these guide recesses 166*a*, 166*b*. A linear guidance is thereby provided as well as an anti-lift device in the height direction 40.

One or more tongues, which are inserted into corresponding guide recesses on the lateral edge elements 162*a*, 162*b*, are also arranged, for example, on the first region 152.

The first fixing element 134 and the second fixing element 136 are slidingly displaceably guided parallel to one another. In connection therewith, the second fixing element 136 lies here with its lower side 168 on the corresponding upper side 150 of the second region 154 and is thereby supported on the second abutment element 126. A slider 170 is arranged projecting laterally on the second fixing element 136. This slider 170 is introduced through an opening 172 in the lateral edge element 162*b*. A lower side of the slider 170 is part of the lower side 168.

The second fixing element 136 is guided in the opening 172 by means of the slider 170, which is arranged on the longer transverse side of the second fixing element 136. Furthermore, the second fixing element 136 is slidingly guided on the second region 154 by means of its lower side 168.

Furthermore, a guidance of the second fixing element 136 is provided on the second abutment element 126. For this purpose, the second fixing element 136 comprises, for example, a guide recess 174, which has a direction of extent parallel to the displacement direction 146. The second abutment element 126, in the region of the step 156 (on the side 128), has a guide strip 176, which is inserted in the guide recess 174 and is formed with an undercut tongue 178 in such a way that when ensuring the guidance, the second abutment element 126 cannot be released from the second fixing element 136 in relation to the displacement direction 36. The undercut tongue 178 provides an anti-release arrangement for the second abutment element 126 in relation to the second fixing element 136 for the direction 36.

The first fixing element 134 also has a slider 180. This is introduced through an opening 182 in the lateral edge element 162*a*. The slider 180 and the slider 170 are positioned on different lateral sides of the abutment device 122. A linear guidance of the first fixing element 134 is in turn provided by the slider 180 in the opening 182. Said first fixing element is also slidingly displaceably guided on the second region 154 of the second abutment element.

The oblique side 140 is supported on the oblique side 144 and oriented parallel thereto. By adjusting a specific displacement position in the displacement direction 146 of the first fixing element 134 and of the second fixing element 136, the spacing of the side 128 with respect to the rear edge element 130 can be fixed and thus the projection of the third abutment face 44 beyond the first abutment element 124 can be adjusted.

Figure 8:
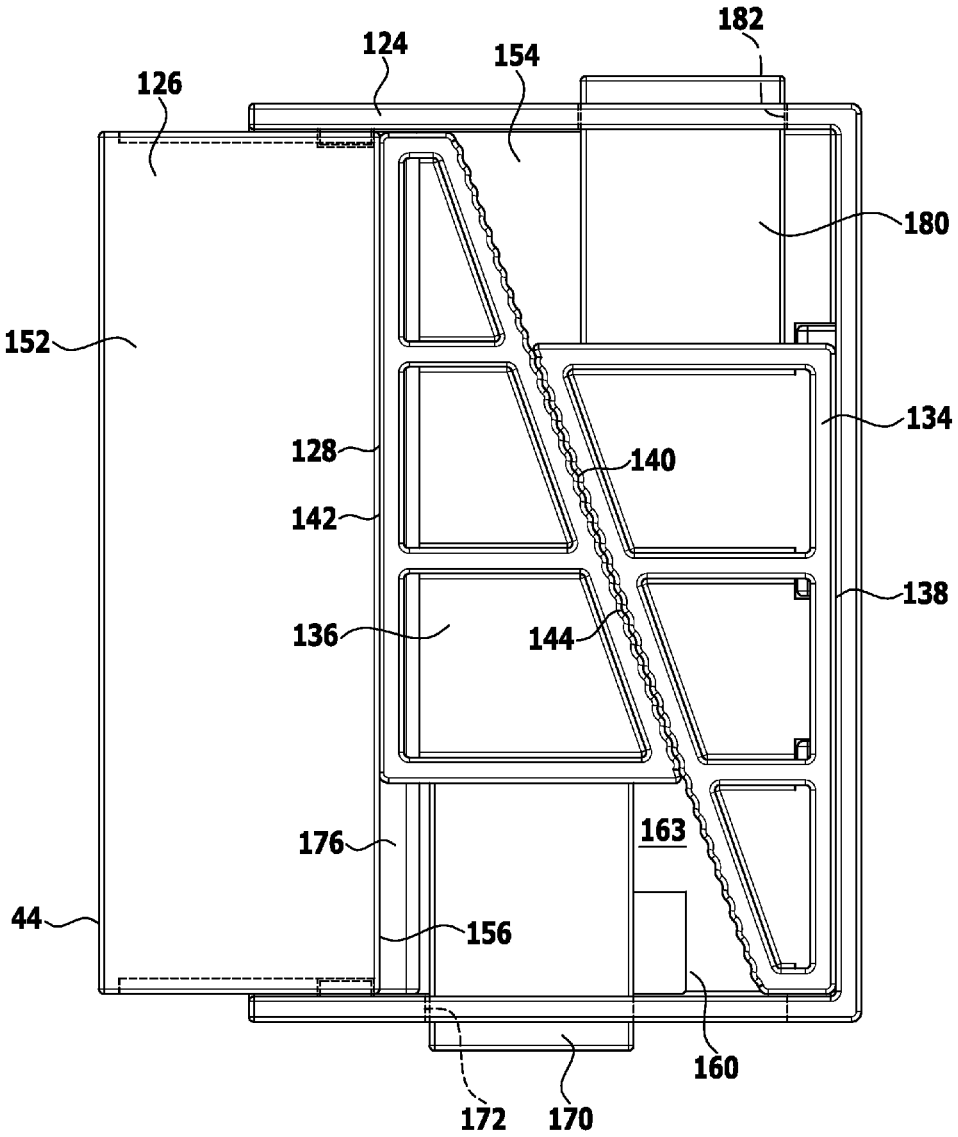
FIG. 8 shows the same view as FIG. 7, the second abutment element being displaced forward relative to the first abutment element.
Figure 9:
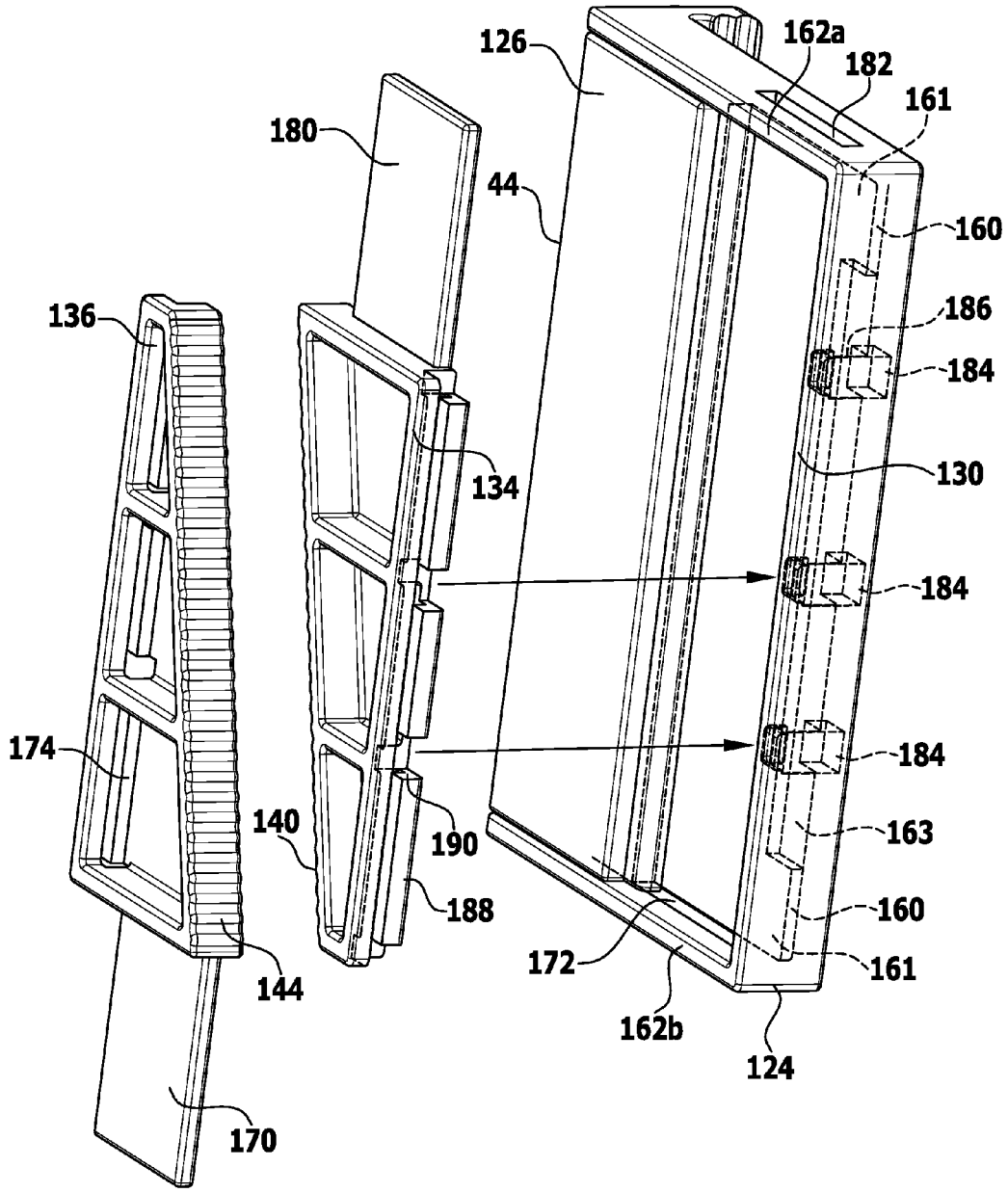
FIG. 9 shows an exploded view of the abutment device according to FIG. 6.
Figure 10:
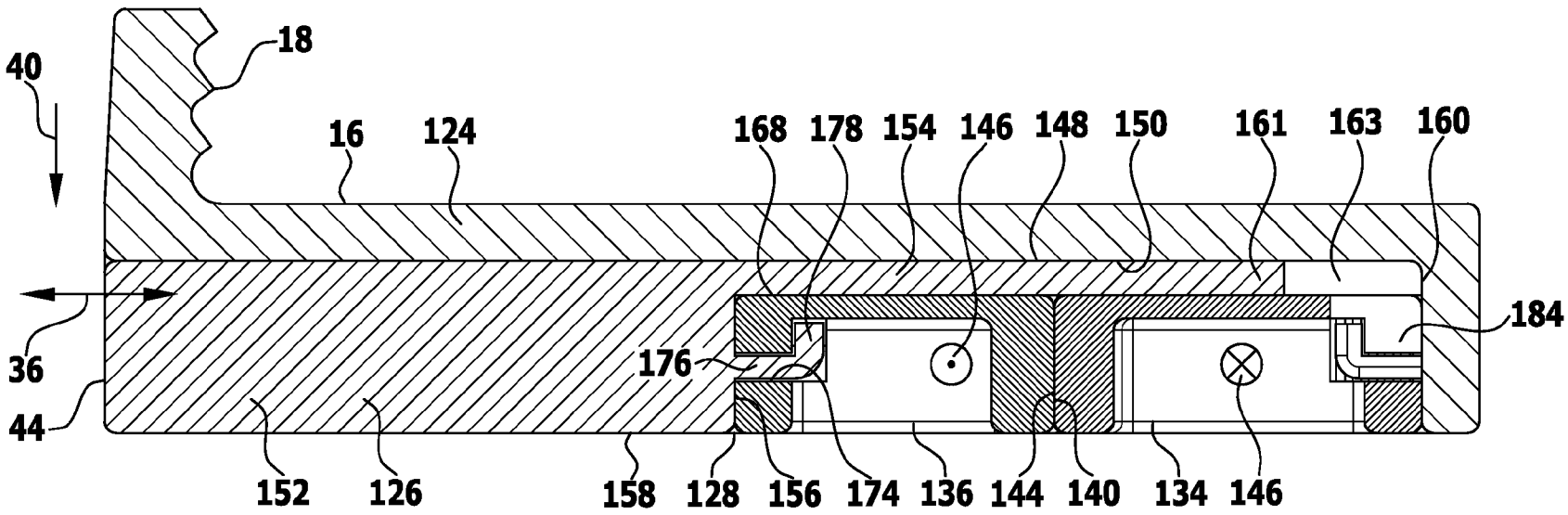
FIG. 10 shows a sectional view along the line 10-10 according to FIG. 7.
Figure 11:
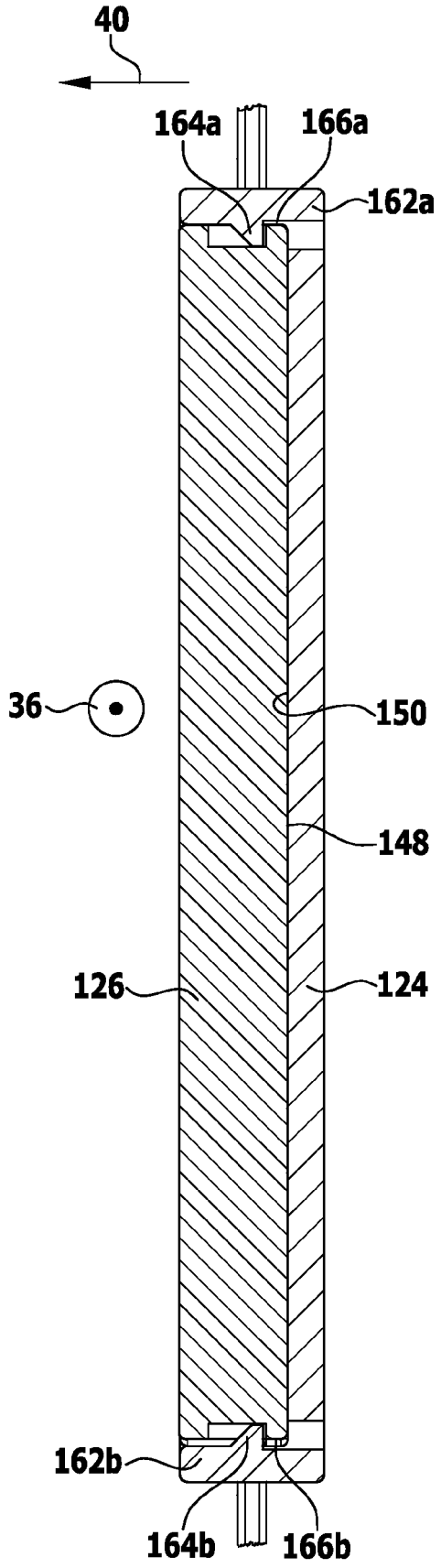
FIG. 11 shows a sectional view along the line 11-11 according to FIG. 7.
Figure 12:
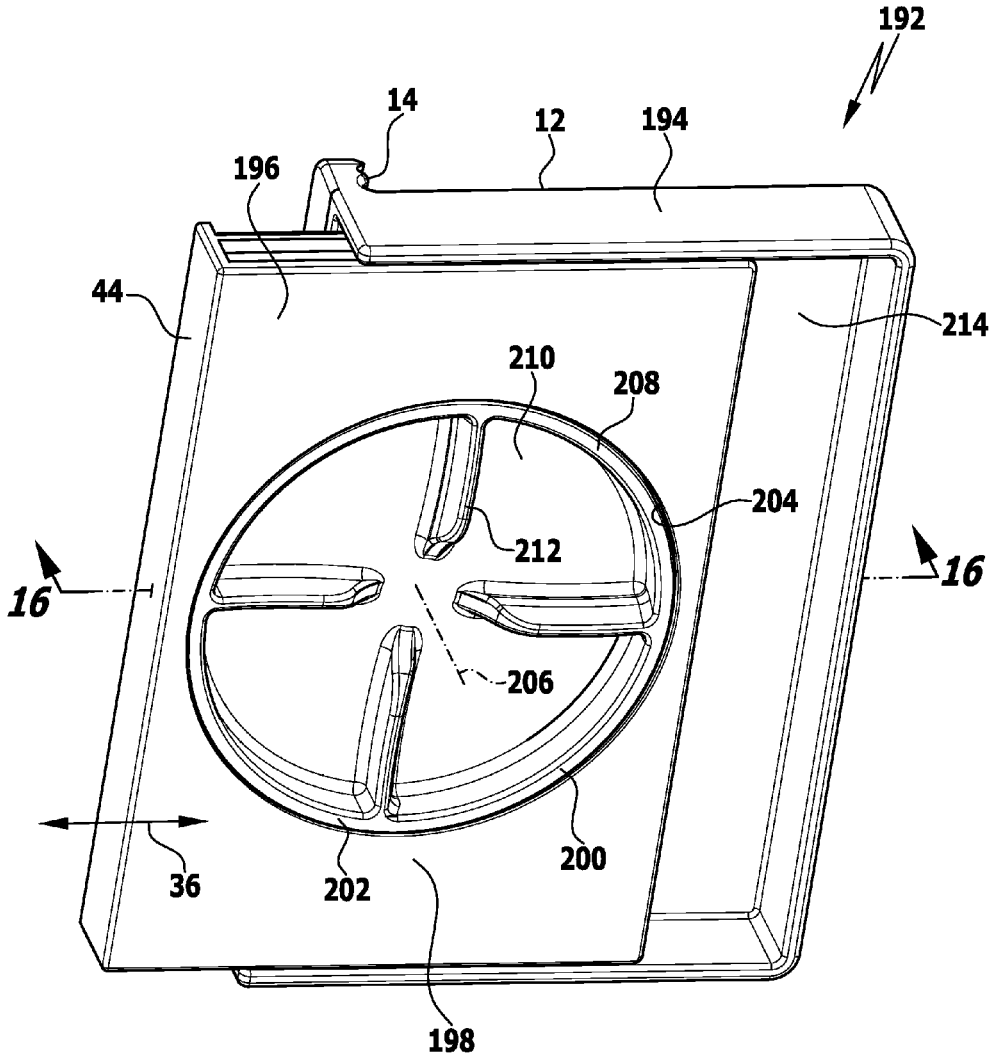
FIG. 12 shows a perspective view of a third embodiment of an abutment device according to the invention, a second abutment element being displaced forward relative to a first abutment element.
Figure 13:
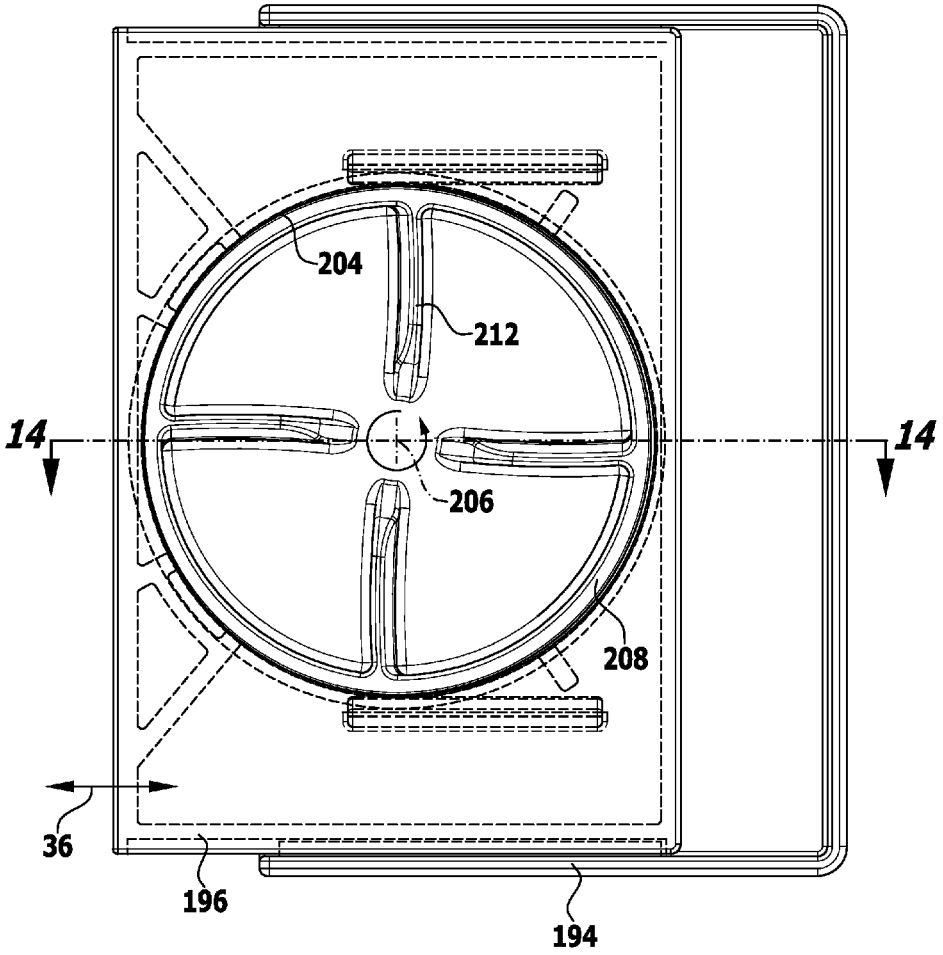
FIG. 13 shows a plan view from above of the abutment device according to FIG. 12.
Figure 14:
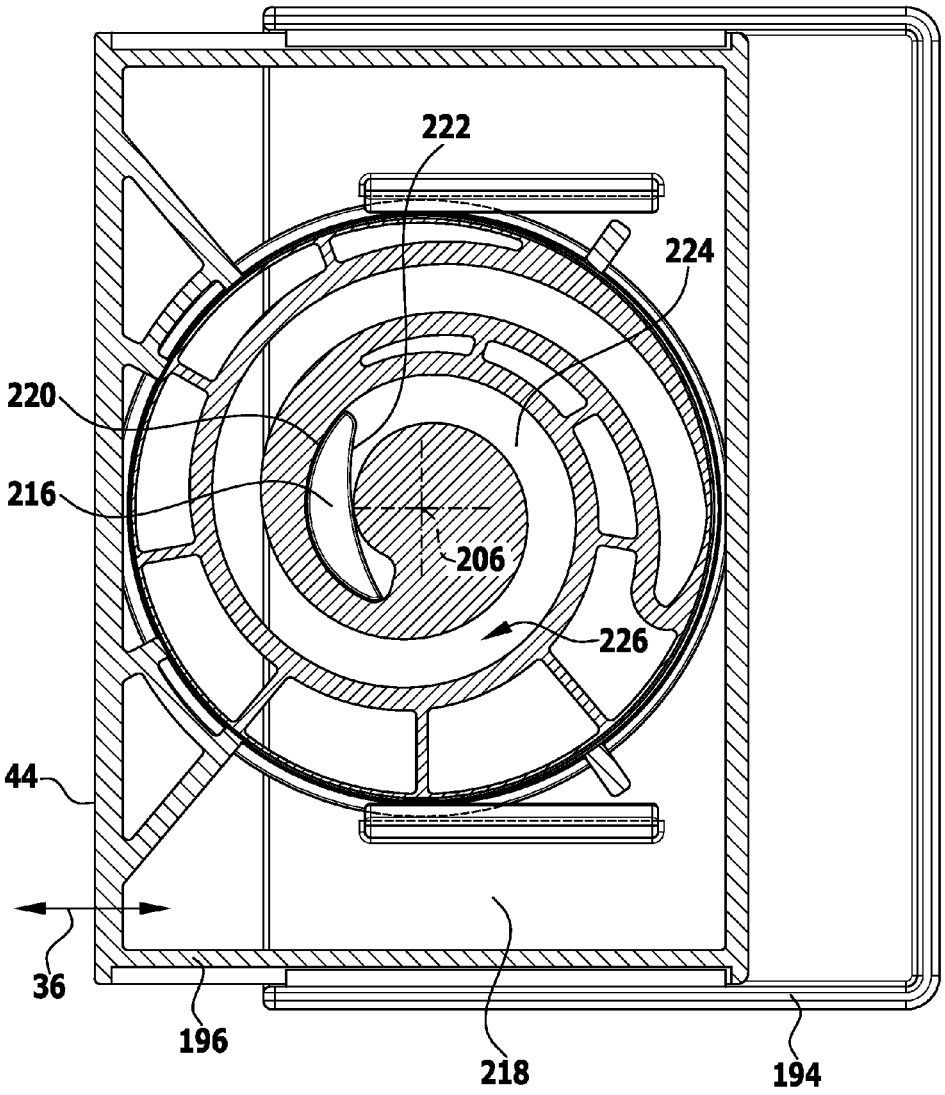
FIG. 14 shows a sectional view along the line 14-14 according to FIG. 13.

The second abutment element 126 with the second region 154 is dimensioned such that even with a maximum withdrawal of the second abutment element 126 in the direction 36 relative to the first abutment element 124, the first fixing element 134 still partially abuts on the second region 154 (cf. FIG. 8).

Guide shoes 184 are arranged on the rear edge element 130 and/or on the second abutment element 126 in the region of the rear edge element 130 and, in particular, in the free space 163 when the second abutment element 126 abuts with the ends 160 on the rear edge element 130. A corresponding guide shoe has a guide recess 186, in which one or more guide strips 188 of the first fixing element 134 are inserted. A guide strip 188 has an undercut tongue 190 here. By means of the guide strip or guide strips 188 and the guide shoes 184, the first fixing element 134 is linearly guided in the displacement direction 146 on the second abutment element 126 in the region of the rear edge element, and specifically in a sliding manner. The undercut tongue or undercut tongues 190 ensure that when the guide strip 188 is introduced in the corresponding guide recess 186 of a guide shoe 184, the first fixing element 134 is secured toward the front in the displacement direction 36 against release.

The fixing elements 134 and 136 are provided with gripping bars, as described in conjunction with the abutment device 10.

Figure 7:
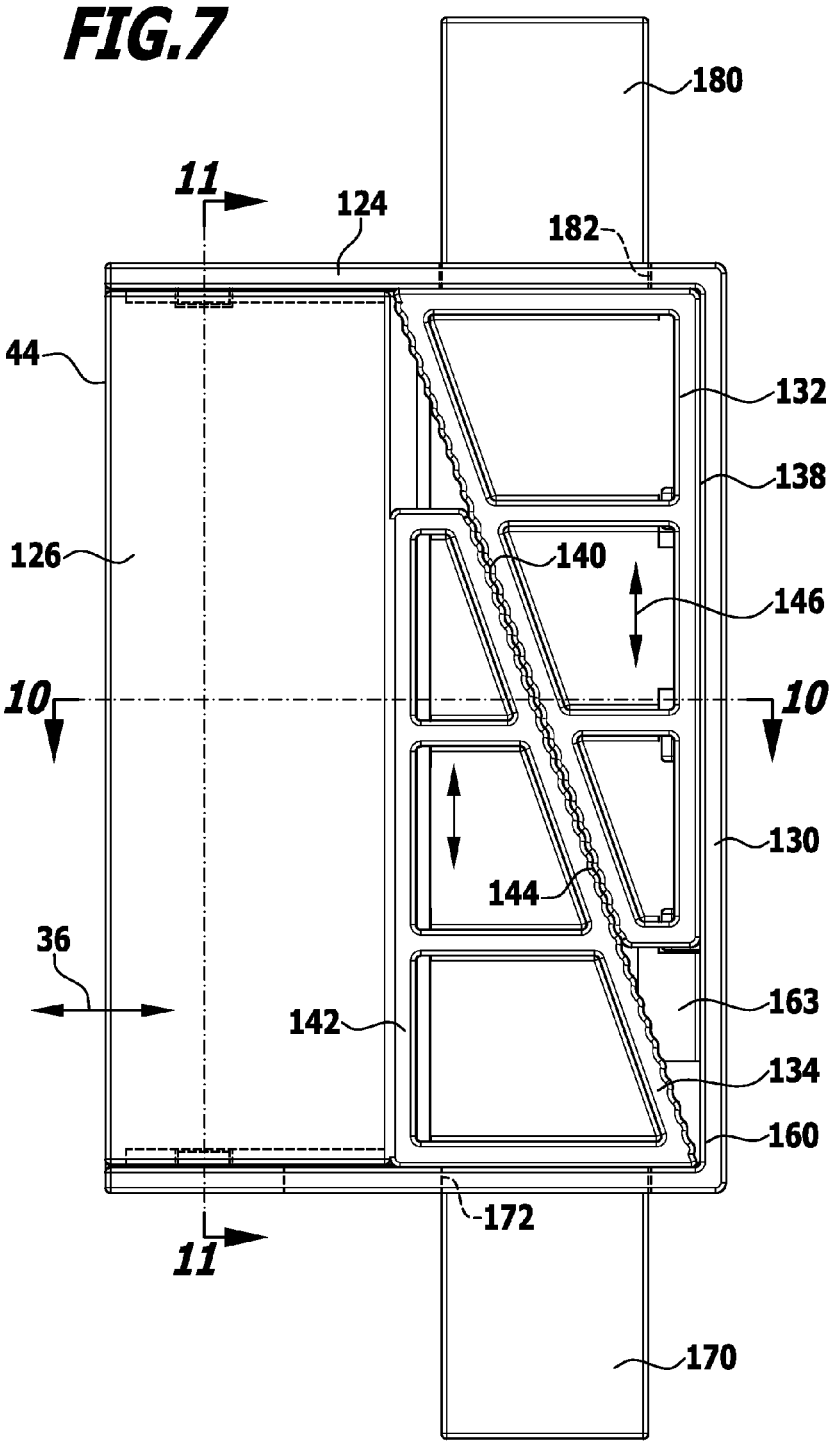
FIG. 7 shows a plan view of the abutment device according to FIG. 6 in a basic position of a second abutment element in relation to a first abutment element.

The abutment device 122 functions as follows:

In a basic position of the abutment device 122, which is shown, for example, in FIG. 7, the second abutment element 126 is displaced in such a way that it does not project beyond the abutment element 124 in the displacement direction 36. For example, the tongues 161 then abut with their ends 160 on the rear edge element 130. The first fixing element 134 and the second fixing element 136 are in a basic position.

When the first fixing element 134 is displaced in the direction of the lateral edge element 162*b* and the second fixing element 136 is displaced in the direction of the lateral edge element 162*a* (FIG. 8), the spacing between the sides 142 and 138 increases. As a result, the second abutment element 126 is displaced forward therefrom in the displacement direction 36 (FIG. 8). The specific position is fixed by supporting the second abutment element 126 by means of the side 128 on the second fixing element 136, which is in turn supported on the first fixing element 134 and which is in turn supported on the first abutment element 124.

By adjusting specific displacement positions of the first fixing element 134 and the second fixing element 136, specific spacings can be fixably adjusted between the third abutment face 44 and the second abutment face 18, the fixing being with respect to a displacement of the second abutment element 126 to the rear edge element 130.

Otherwise, the abutment device 122 functions as above with the aid of the abutment device 10.

A third embodiment of an abutment device according to the invention, which is shown in FIGS. 12 to 16 and designated 192 there, in turn comprises a first abutment element 194 with a first abutment face 12 and a second abutment face 14. A second abutment element 196 is guided with a third abutment face 44 in the manner of drawer on the first abutment element 194.

The relative position of the second abutment element 196 and therefore the third abutment face 44 with respect to the second abutment face 14 is fixably displaceable by means of a fixing mechanism 198. The fixing mechanism 198 in turn comprises a fixing element 200. This fixing element 200 is formed as a rotary knob. The fixing element 200 is a rotary knob 202. It is rotatably mounted in a cylindrical recess 204 of the second abutment element 106 in the manner of an external shaft with a rotational axis 206, which is transverse and, in particular, perpendicular to the displacement direction 36.

The rotary knob 202 has an edge 208, which is cylindrical. This edge 208 projects above an upper side 210 of the rotary knob 202. Gripping bars 212, which are, for example, arranged in a cross-like manner with respect to one another and by means of which an operator can take hold of the rotary knob 202 for a rotary actuation, are connected to the edge.

The first abutment element 194 has a recess 214, in which the second abutment element 196 is guided. An engagement element 216 is arranged in the recess 214 in a front region. This engagement element projects beyond a base 218 of the recess 214. The engagement element 216 has a curved first side 220 and a curved second side 222.

The rotary knob 202, facing the base 218 of the recess 214, has a guide path 224. The engagement element 216 is inserted into the guide path 224.

The rotary knob 202 is provided with an eccentric mechanism 226. This eccentric mechanism 226 is formed by means of the guide path 224. By means of a rotation at the rotary knob 202, a linear movement of the second abutment element 196 takes place relative to the first abutment element 194; the latter is displaced in the displacement direction 36.

The guide path 224 is a spiral path. It is, for example, formed by means of a logarithmic spiral. A spiral of this type has a self-locking effect. When a specific rotational position of the rotary knob 202 is set, a displacement position of the second abutment element 196 with respect to the first abutment element 194 is also thereby fixed.

Figure 15:
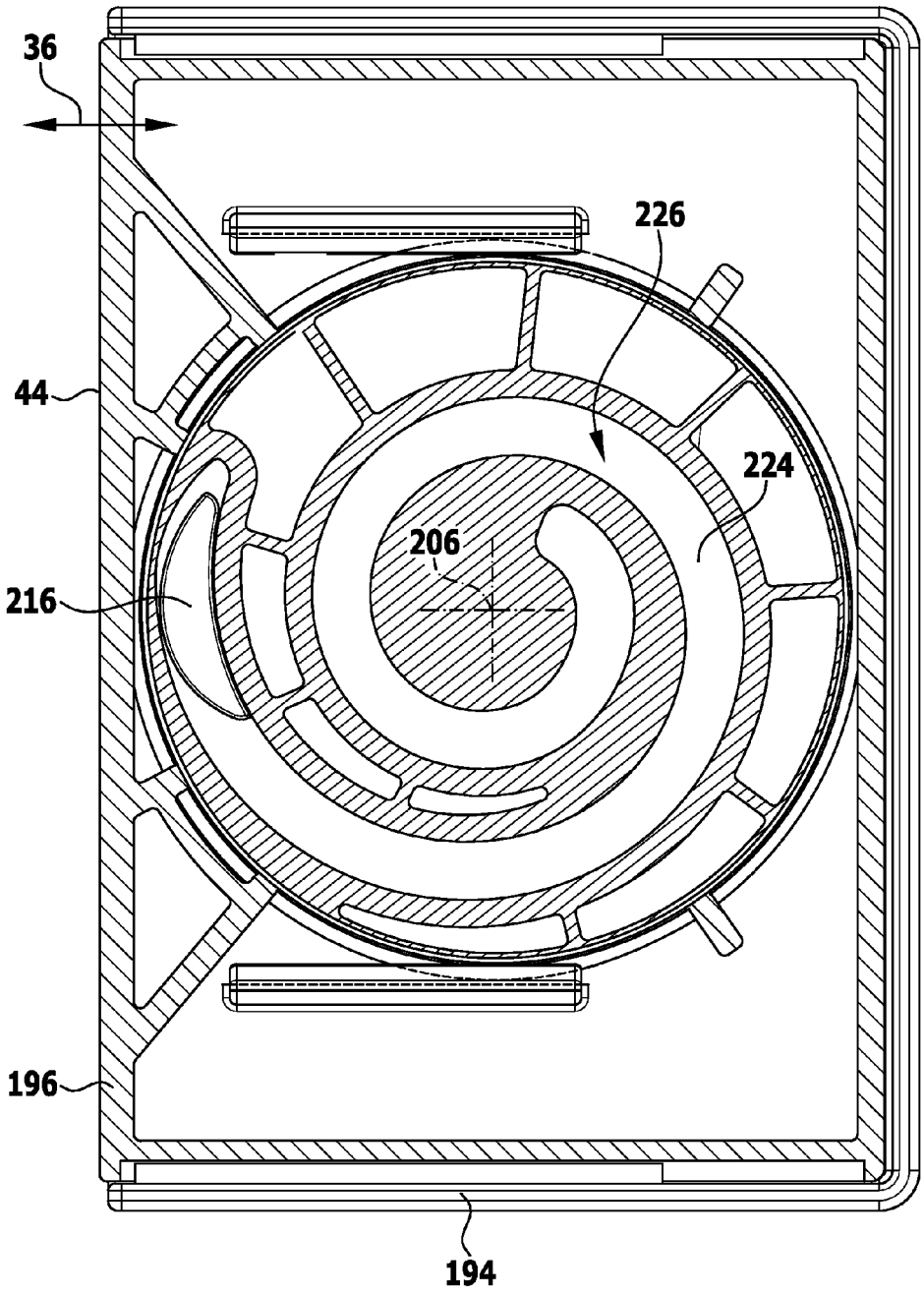
FIG. 15 shows the same view as FIG. 14, the second abutment element being in a basic position relative to the first abutment element.
Figure 16:
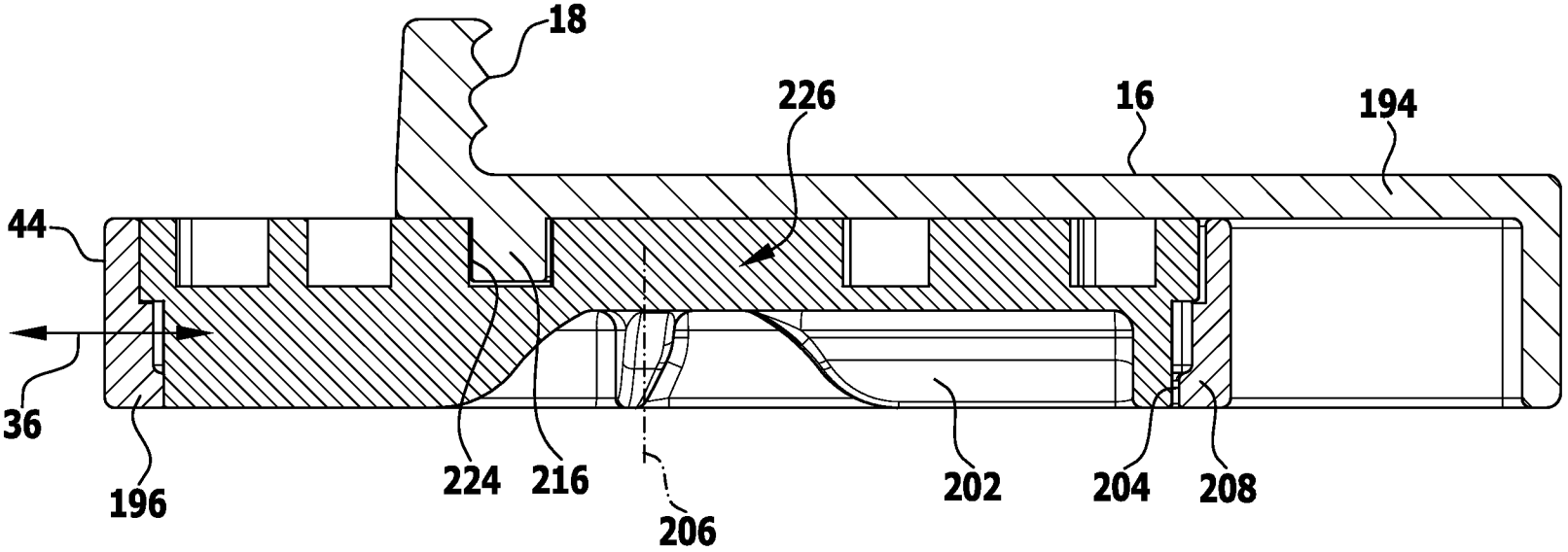
FIG. 16 shows a sectional view along the line 16-16 according to FIG. 12.

The abutment device 192 functions as follows:

FIG. 15 shows a basic position, in which the first abutment element 196 is displaced to the rear in relation to the first abutment element 194; the third abutment face 44 and the second abutment face 18 have a minimal spacing there.

By rotating the rotary knob 202, the guide path 224 is displaced relative to the engagement element 216. The engagement element 216 is configured here in such a way that in each position within the guide path 224 it abuts with the first side 220 and the second side 222 on delimitations of the guide path 224 and therefore there is minimized play (cf. FIGS. 14 and 15). The guide path 224 is eccentric. The rotation brings about a displacement of the second abutment element 196 relative to the first abutment element 194. The spacing between the third abutment face 44 and the second abutment face 18 is thereby increased (cf. FIGS. 12 and 14). At the same time, owing to the abutment of the engagement element 216 with the first side 220 and the second side 222 on delimitation of the guide path and owing to the self-locking configuration of the eccentric mechanism 226, the specific displacement position is fixed.

Otherwise, the abutment device 192 functions as described above with reference to the abutment device 10 and 122.

It is basically also possible for the engagement element 216 to be arranged on the rotary knob 202 and for the corresponding guide path 124 to be arranged on the first abutment element 194.

List of Reference Numerals

10 abutment device (first embodiment)
12 first abutment element
14 second abutment element
16 first abutment face
18 second abutment face
20 first region
22 second region
24 profiling
26 line
28 recess
30 edge
32*a* lateral edge element
32*b* lateral edge element
34 rear edge element
36 displacement direction
38 upper side
40 height direction
42 upper side
44 third abutment face
46*a*, a', a" guide recess
46*b, b*', b" guide recess
48*a* cover strip
48*b* cover strip
50 side
52*a*, a', a" strip element
52*b, b*', b" strip element
54 cover element
56 ribs
58 upper side
60*a* outer rib
60*b* outer rib
62 front region
64 walls
66 oblique side
68 acute angle
70 rear side
72 side
74 profiling
76 fixing mechanism
78 fixing element
80 displacement direction
82 side
84 side
86 side
88 oblique side
90 profiling
92*a* bars
92*b* bars
94*a* depression
94*b* depression
94*c* depression
96 guide mechanism
98 guide strip
100 guide recess
102 lower side
104 guide recess
106 tongue
108 foot
110 recess
112 insertion element
114 end
116 base element close to a wall
118 wall
120 end face
122 abutment device (second embodiment)
124 first abutment element
126 second abutment element
128 side
130 rear edge element
132 fixing mechanism
134 first fixing element
136 second fixing element
138 side
140 oblique side
142 side
144 oblique side
146 displacement direction
148 lower side
150 upper side
152 first region
154 second region
156 step
158 upper side
160 end
162*a* lateral edge element
162*b* lateral edge element
163 free space
164*a* cover strip
164*b* cover strip
166*a* guide recess
166*b* guide recess
168 lower side
170 slider
172 opening
174 guide recess
176 guide strip
178 undercut tongue
180 slider
182 opening
184 guide shoe
186 guide recess
188 guide strip
190 undercut tongue
192 abutment device (third embodiment)

194 first abutment element
196 second abutment element
198 fixing mechanism
200 fixing element
202 rotary knob
204 recess
206 rotational axis
208 edge
210 upper side
212 gripping bar
214 recess
216 engagement element
218 base
220 first side
222 second side
224 guide path
226 eccentric mechanism

The invention claimed is:

1. Method for laying floor elements, wherein at least one abutment device is provided, said at least one abutment device comprising:

a first abutment element with a first abutment face and a second abutment face which is oriented transversely to the first abutment face; and a second abutment element with a third abutment face which is oriented transversely to the first abutment face, said second abutment element being slidingly displaceably guided in a fixable manner on the first abutment element, and a spacing between the first abutment face and the third abutment face being fixably adjustable;

wherein the first abutment element, on a side opposite to the first abutment face, has a recess, which is limited by an edge and in which the second abutment element is arranged;

said method comprising:

placing the at least one abutment device with the first abutment face on an upper side of a floor element close to a wall;

placing the second abutment face on an end face of the floor element facing a wall;

placing the third abutment face on the wall; and adjusting a spacing of the floor element from the wall by means of a relative position of the second abutment element with respect to the first abutment element.

2. Method according to claim 1, wherein:

after the floor element has been fixed, the at least one abutment device is removed upwardly, and a possible clamping of the abutment device between the wall and floor element is released by at least one of releasing the fixing and changing the position of the second abutment element with respect to the first abutment element.

3. Abutment device comprising:

a first abutment element with a first abutment face and a second abutment face which is oriented transversely to the first abutment face;

a second abutment element with a third abutment face which is oriented transversely to the first abutment face, said second abutment element being slidingly displaceably guided in a fixable manner on the first abutment element, and a spacing between the first abutment face and the third abutment face being fixably adjustable; and a fixing mechanism, by means of which a relative position of the second abutment element with respect to the first abutment element is adjustably fixable at least in a direction from the third abutment face toward the second abutment face;

wherein:

the first abutment element, on a side opposite to the first abutment face, has a recess, which is limited by an edge and in which the second abutment element is arranged:

the fixing mechanism has at least one fixing element, which is supported on at least one of the first abutment element and the second abutment element; and the at least one fixing element is configured as a wedge element.

4. Abutment device according to claim 3, wherein the second abutment face and the third abutment face are at least approximately parallel to one another.

5. Abutment device according to claim 3, wherein:

the second abutment face is transverse to the first abutment face; and the first abutment face and the second abutment face intersect in a line.

6. Abutment device according to claim 5, wherein the line is at least approximately parallel to the third abutment face.

7. Abutment device according to claim 3, wherein the first abutment element in cross section has an L-shaped configuration with the first abutment face and the second abutment face.

8. Abutment device according to claim 3, wherein a first region of the first abutment element, on which the first abutment face is formed, and a second region of the first abutment element, on which the second abutment face is formed, are in one piece.

9. Abutment device according to claim 3, wherein the first abutment element has an undulating structure on the second abutment face.

10. Abutment device according to claim 3, wherein the second abutment element is supported on the first abutment element.

11. Abutment device according to claim 3, wherein the second abutment element is linearly displaceably guided on the first abutment element by means of a guide mechanism.

12. Abutment device according to claim 11, wherein the guide mechanism is configured as an anti-lift device for the second abutment element relative to the first abutment element.

13. Abutment device according to claim 11, wherein the guide mechanism has opposite guide recesses, which are in each case limited by a cover strip and in which respective guide strips are inserted.

14. Abutment device according to claim 13, wherein the cover strips are beveled on a side remote from the first abutment face.

15. Abutment device according to claim 3, wherein the second abutment element does not project beyond the edge of the recess in a height direction.

16. Abutment device according to claim 3, wherein:

the at least one fixing element comprises at least a first fixing element and a further fixing element;

the first fixing element is supported on the further fixing element.

17. Abutment device according to claim 3, wherein the at least one fixing element has at least one gripping bar for hand actuation.

18. Abutment device according to claim 3, wherein the at least one fixing element is movably arranged relative to the first abutment element and movably arranged relative to the second abutment element.

19. Abutment device according to claim 18, wherein the at least one fixing element is movable in a direction which is oriented transversely to a movement direction of the second abutment element relative to the first abutment element.

20. Abutment device according to claim 3, wherein the at least one fixing element is linearly displaceably mounted on at least one of the first abutment element and the second abutment element.

21. Abutment device according to claim 3, wherein:

the at least one fixing element has an oblique side, which is oriented at an acute angle to the third abutment face and on which a support face is formed, and the at least one fixing element is supported on a corresponding oblique side of the first abutment element or of the second abutment element or a further fixing element, which is oriented parallel to the oblique side of the at least one fixing element.

22. Abutment device according to claim 21, wherein mutually supporting oblique sides are provided with an undulating structure.

23. Abutment device according to claim 3, wherein the at least one fixing element or a further fixing element is linearly displaceably guided on the second abutment element.

24. Abutment device according to claim 3, wherein the at least one fixing element forms a spacer between the second abutment element and the first abutment element, which spacer fixes the spacing between the second abutment face and the third abutment face, at least in one direction.

25. Abutment device comprising:

a first abutment element with a first abutment face and a second abutment face which is oriented transversely to the first abutment face;

a second abutment element with a third abutment face which is oriented transversely to the first abutment face, said second abutment element being slidingly displaceably guided in a fixable manner on the first abutment element, and a spacing between the first abutment face and the third abutment face being fixably adjustable;

a fixing mechanism, by means of which a relative position of the second abutment element with respect to the first abutment element is adjustably fixable at least in a direction from the third abutment face toward the second abutment face;

the fixing mechanism having at least one fixing element, which is supported on at least one of the first abutment element and the second abutment element; and an eccentric mechanism, by means of which, by rotating the at least one fixing element, a linear displacement of the second abutment element relative to the first abutment element is fixably actuatable;

wherein:

the first abutment element, on a side opposite to the first abutment face, has a recess, which is limited by an edge and in which the second abutment element is arranged;

the at least one fixing element is rotatably mounted on the second abutment element;

an eccentric guide path for at least one engagement element is arranged on the at least one fixing element, the at least one engagement element being seated on the first abutment element or the at least one fixing element; and the eccentric guide path is a spiral path.

26. Abutment device according to claim 25, wherein the eccentric mechanism is self-locking, such that a relative displacement position between the second abutment element and the first abutment element is fixed by a specific rotational position of the at least one fixing element.

27. Abutment device comprising:

a first abutment element with a first abutment face and a second abutment face which is oriented transversely to the first abutment face;

a second abutment element with a third abutment face which is oriented transversely to the first abutment face, said second abutment element being slidingly displaceably guided in a fixable manner on the first abutment element, and a spacing between the first abutment face and the third abutment face being fixably adjustable; and a fixing mechanism, by means of which a relative position of the second abutment element with respect to the first abutment element is adjustably fixable at least in a direction from the third abutment face toward the second abutment face;

wherein:

the first abutment element, on a side opposite to the first abutment face, has a recess, which is limited by an edge and in which the second abutment element is arranged;

the fixing mechanism has at least one fixing element, which is supported on at least one of the first abutment element and the second abutment element; and the at least one fixing element has an oblique side, which is oriented at an acute angle to the third abutment face and on which a support face is formed, and the at least one fixing element is supported on a corresponding oblique side of the first abutment element or of the second abutment element or a further fixing element, which is oriented parallel to the oblique side of the at least one fixing element.

* * * * *